United States Patent [19]

Miller

[11] 4,048,606

[45] Sept. 13, 1977

[54] INDUCTIVE DEVICE WITH BOBBIN

[75] Inventor: Imrich M. Miller, Paterson, N.J.

[73] Assignee: Universal Manufacturing Corporation, Paterson, N.J.

[21] Appl. No.: 729,816

[22] Filed: Oct. 5, 1976

Related U.S. Application Data

[63] Continuation of Ser. No. 580,015, May 22, 1975, abandoned.

[51] Int. Cl.[2] ..... H01F 27/30

[52] U.S. Cl. ..... 336/198; 29/605; 242/118.4

[58] Field of Search ..... 336/198, 208; 242/118.4, 7.15; 29/605

[56] References Cited

U.S. PATENT DOCUMENTS

| | | | |
|---|---|---|---|
| 2,351,023 | 6/1944 | Dunham | 336/208 X |
| 2,511,174 | 6/1950 | Osborne | 336/198 |
| 3,453,575 | 7/1969 | Davis | 336/198 X |
| 3,680,018 | 7/1972 | Elberger | 336/208 X |
| 3,781,741 | 12/1973 | Weiner | 336/198 X |
| 3,878,494 | 4/1975 | Ghariabeh | 336/208 |

FOREIGN PATENT DOCUMENTS

| | | | |
|---|---|---|---|
| 550,185 | 2/1923 | France | 336/198 |

*Primary Examiner*—Thomas J. Kozma
*Attorney, Agent, or Firm*—Darby & Darby

[57] ABSTRACT

An inductor device including an outer frame type shell of magnetically susceptible material and a bobbin of insulating material on which a coil of wire is wound, with the bobbin fitting within the shell. The bobbin has the edges of its flanges bent over to provide electrical insulation against creepage and, in the preferred embodiment of the invention, the bobbin flanges are of a heat settable material. A method of manufacturing the inductive device with the bobbin is also disclosed.

1 Claim, 5 Drawing Figures

INDUCTIVE DEVICE WITH BOBBIN

This is a continuation of application Ser. No. 580,015, filed May 22, 1975, now abandoned.

Inductive devices, such as transformers, are widely used. Most conventional inductive devices use a bobbin on which a coil of wire is wound. The bobbin, with the coil wound thereon, is placed within the "window" formed by the laminations of the device to complete the magnetic path for the lines of flux produced when current is applied to the coil.

In general, it is desired to wind the coil on the bobbin so that the outer layer of wire of the coil lies closely adjacent to the inner surface of the laminations. By doing this, the overall size of the device is minimized and its efficiency is increased. However, when the wire lies close to the laminations a problem arises, especially at the inner corners of the lamination window, in that a "creepage" path is afforded between the outer layers of the coil and the inner surface of the laminations forming the window. The creepage path permits current to burn through the wire insulation and cause the device to break down.

One way to overcome the insulation creepage problem is to wind the coil on the bobbin only to about 70–80% of its diameter. This leaves an air space between the outer coil layer and the inner surface of the transformer laminations. This space can be left or filled up with other insulation, for example, paper or other similar material. The technique of leaving empty space on the bobbin is unsatisfactory since, if the maximum diameter of the bobbin is not utilized for winding the coil, material will be wasted. For example, the larger the size of the bobbin needed to accommodate a given number of turns for the coil, the greater will have to be the size of the surrounding area of the transformer lamination to accommodate it. Further, where the bobbin contains empty space where the wire coil normally could be wound, were it not for the creepage path, there is a reduction in the coupling between the current in the coil and the transformer lamination.

The present invention relates to an inductive device and a method for manufacturing the same in which a bobbin of novel shape is used. The bobbin is made so that it can be substantially fully used for winding the coil thereby fully utilizing all the bobbin space and reducing the amount of lamination material necessary to produce good magnetic coupling.

In the preferred embodiment of the invention, the bobbin has the usual center leg, or core, and side flanges. At least the flanges of the bobbin are made of a relatively rigid material having electrical insulating properties which can be bent down over the edge of the coil after the coil has been wound on the bobbin core. The bobbin can then be fitted in the lamination window with the bent down portion of the bobbin serving as insulation for the creepage path at the corners of the window.

In a preferred embodiment of the invention, at least the flanges of the bobbin are made of a heat settable material, for examples nylon. This permits the corners of the flanges to be formed quite easily in a heated die.

In U.S. Pat. No. 1,485,289 to Peterson, a bobbin having flanges of layers of fabric is disclosed and the layers are dipped in a liquid resin. Such a bobbin is difficult to form. In U.S. Pat. No. 2,511,174 to Osborne, a cardboard bobbin with oversized flanges is shown. These flanges are relatively difficult to form efficiently and the insulating properties of cardboard is not entirely satisfactory. U.S. Pat. No. 1,708,211 to Bates, Lanphier U.S. Pat No. 2,138,606 and Purdy U.S. Pat. No. 3,070,766 show bobbins with various types of end members.

It is therefore an object of the invention to provide a novel inductive device using a bobbin whose edges can be bent down to provide additional insulation against the creepage path at the corner of the lamination window in which the bobbin fits.

An additional object is to provide a bobbin for the coil of an inductive device made of a heat settable material which is deformed, after the coil is wound on the bobbin, to provide creepage insulation at the bobbin edges.

Another object is to provide a method of manufacturing an inductive device in which the edges of the bobbin are bent down over a portion of the coil on the bobbin by a heating operation.

Other objects and advantages of the present invention will become more apparent upon reference to the following specification and annexed drawings, in which.

Figure 1A:
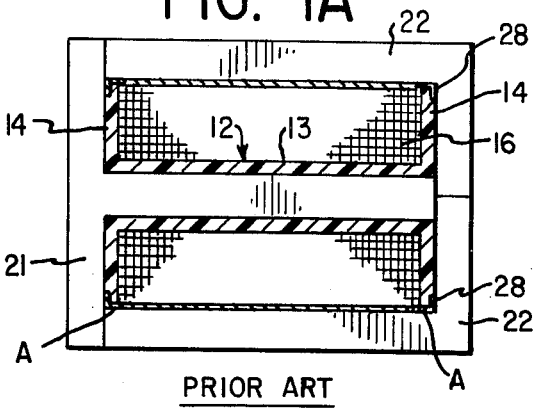
FIG. 1A–1B are views in cross-section of prior art types of inductive devices.

Referring to FIG. 1A, a typical prior art inductive device is shown including a bobbin 12 having a hollow center leg, or core section 13 and end flanges 14. The bobbin core can be round or square or rectangular or of other similar shape. Similarly, the flanges 14 can be round, rectangular, square, etc.

A coil of wire 16 is wound within the space defined by bobbin core 13 and flanges 14. The wire 16 can be of any suitable diameter and of any suitable material, for example, aluminum or copper.

In normal manufacture of inductive devices, after the coil 16 is wound on the bobbin, it is inserted within a window defined by a stack of laminations, which are here shown as being of a T-L type. That is, one lamination 21 is of T-shape and its center leg fits within the hollow bobbin core while two other laminations 22 are of L-shape and surround the outer edge of the bobbin and one of the flanges 14.

A creepage path exists between the outer coil and the inner face of the laminations. That is, there is a space between which the voltage can arc over or creep. One or more layers of insulation material 25, such as paper, or tape, are placed over the outermost winding of the core. The purpose of layer 25 is to prevent the voltage in the coil, and particularly its outermost winding, from arcing or burning through to the inner face of the laminations.

The creepage problem is particularly acute at the four corners of the window, designated A, since quite often the insulation 25 does not fit and there is more magnetic material at the corners of the lamination. In one arrangement for overcoming the effects of this corner creepage path, as shown in FIG. 1A, special insulating pieces 28 are placed at the corners of the lamination window. This arrangement is unsatisfactory from the point of view of cost and complexity of assembly.

Figure 1B:
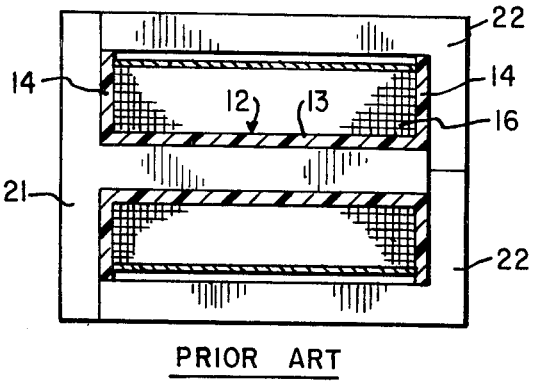

FIG. 1B shows another arrangement used to overcome the creepage problem. Here, the coil 16 is only wound approximately about 70–80% of the diameter of the bobbin flanges. While this configuration is normally adequate for preventing or reducing breakdown due to creepage, it presents a disadvantage in that there is a considerably waste of material. That is, the laminations must be made oversize resulting in a waste of material.

Figure 2:
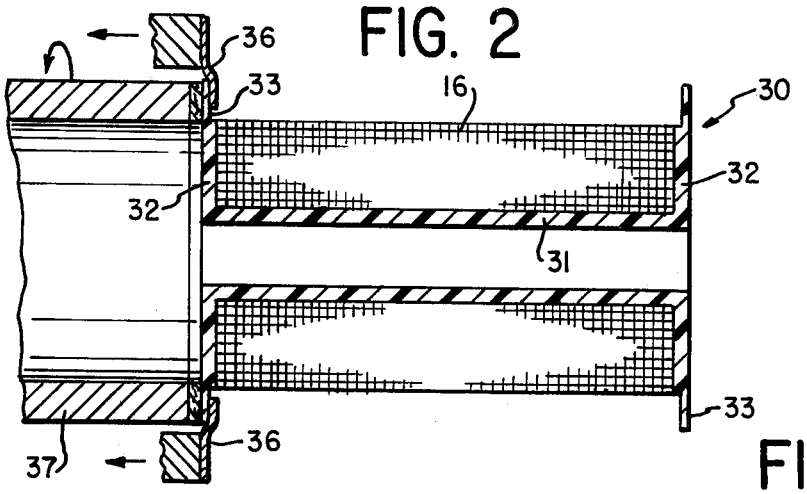
FIG. 2 is a view in cross-section of a bobbin in accordance with the invention mounted for winding the coil.

Referring to FIG. 2, a bobbin 30 made in accordance with the subject invention is shown. The bobbin has the usual hollow core 31 and an outer flange 32 on each end. The peripheral portion 33 of each flange 32 is preferably thinned down for reasons described below. The thinned down peripheral portions 33 are preferably continuous around the outer edge of each flange. At least the flanges 32 of the bobbin are preferably made of a material which has suitable electrical insulation properties, is substantially rigid and which can be heat-formed. One suitable material is NYLON. Others are polyvinyl chloride plastics. The bobbin is preferably molded and its core and flanges are relatively rigid.

As seen in FIG. 2, the coil 16 is wound over the bobbin core out to the edge of the thick portion of the flange. Any conventional coil winding technique can be utilized.

In manufacturing, the thinned down portions 33 of the flange permit a further advantage since a clamping device, illustrated by the fingers 36, can be placed thereon to hold the bobbin in a fixed position as the coil is being wound. In FIG. 2, the bobbin is shown clamped against a mandrel 37 which would normally rotate. The member 37 also could be fixed. The clamping of the flange provides a further advantage in preventing warping of the flanges during winding on automatic high-speed winding machines.

Figure 3:
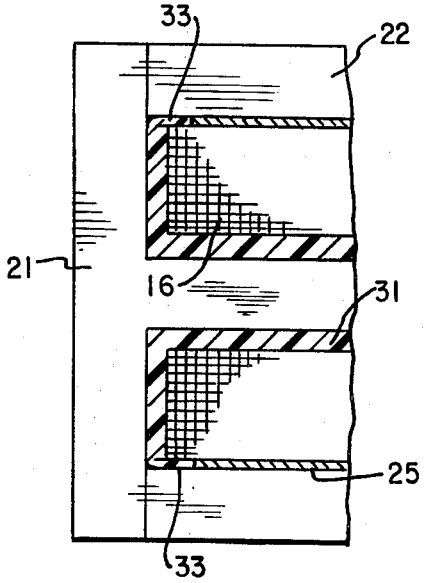
FIG. 3 is a cross-section of a fragment of an inductive device completed in accordance with the invention.

FIG. 3 shows the bobbin 30 assembled within the laminations. As seen, the thinned down portion 33 of each of the flanges has been bent over the edge of coil 16. The insulating layer 25 is laid over the outer winding of the coil between the inner edges of portions 33. The bobbin configuration permits the inner surface of the laminations to be butted up against or lie closely adjacent to the outer faces of the bent over flange edges 33 and the insulating layer 25. Since the bobbin flange comprises an insulating material of good characteristics a high resistance to creepage is provided. Further, since the portions 33 of the flange are relatively thin, there is little or no wasted space between the coil and the laminations. In a preferred embodiment, the thickness of the portion 33 and that of the insulation layer, or layers, 25 is made the same.

Figure 4:
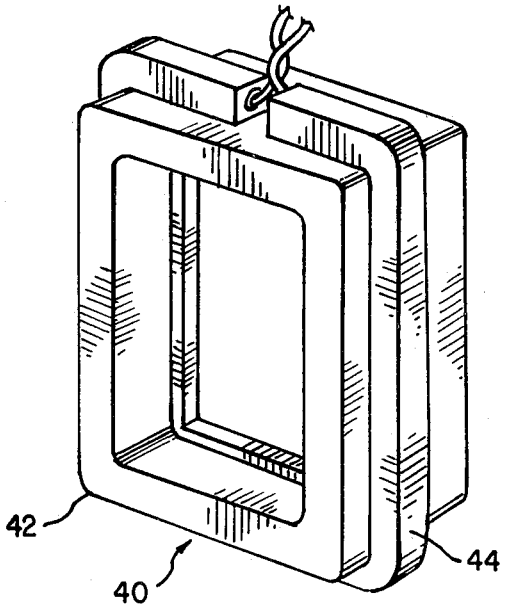
FIG. 4 is a view of a heat jig for bending the flange edges of the bobbin.

FIG. 4 shows a die 40 for forming the edges 33 of the flanges 32 over the outer surface of the coil. The die has a heated ring 42 which conforms to the outline of the flange 32 out to the beginning of the thinned down portion 33. The die may be heated by any suitable means, for example, an electrical resistance element 44.

The method of manufacturing an inductive device according to a preferred embodiment of the invention proceeds as follows. A bobbin 30 is first placed in the clamp 36 and the coil 16 wound on the core 31 by any suitable process. After the coil is wound to the desired thickness, the bobbin is removed from the clamp and the edge of a flange 32 is inserted in the die 40 to heat and turn down the thinned down section 33 of the flange over the outer face of the coil. The bobbin is removed from the die and the section 33 cools to set it in the proper position. This operation is repeated for the other flange. The insulation 25 is placed over the coil 16 and the bobbin is then assembled in the laminations in the usual manner.

As should be apparent, a novel and highly advantageous transformer device and method for making the same has been disclosed in which the problem of creepage, where the bobbin coil interfaces with the corners of the transformer lamination, is eliminated.

What is claimed is:

1. An inductive device comprising in combination:

lamination means defining an open window, a bobbin of electrically insulating material having a core with a multi-sided polygonal flange on each of its ends, each of said flanges being of a heat settable thermoplastic material and integrally formed with a continuous peripheral stiff edge on at least two of its sides which stiff edge initially extends outwardly from and is thinner than the other portion of the respective flange, the flanges being reduced in thickness on the respective inner faces thereof to form the thinned down edge, a coil of wire on said core which extends to the inner face of each of said flanges and substantially up to the point where the thinned edge of the flange commences, said bobbin fitting within said lamination window with the thinned down continuous edges of the respective flange heat set and bent over the coil on the bobbin core and said bent down edges lying directly adjacent the corners of the window to reduce the electrical creepage path between the coil and the inner face of the lamination at the corners of the window.

* * * * *